United States Patent [19]

Kouno et al.

[11] Patent Number: 4,475,424

[45] Date of Patent: Oct. 9, 1984

[54] BLANKING APPARATUS

[75] Inventors: Shigeyoshi Kouno, Zama; Masakazu Okajima, Isehara, both of Japan

[73] Assignee: Amada Company, Limited, Japan

[21] Appl. No.: 330,400

[22] Filed: Dec. 14, 1981

[30] Foreign Application Priority Data

| | | | |
|---|---|---|---|
| Dec. 15, 1980 | [JP] | Japan | 55-177003 |
| Dec. 24, 1980 | [JP] | Japan | 55-182091 |
| Dec. 24, 1980 | [JP] | Japan | 55-182088 |
| Dec. 25, 1980 | [JP] | Japan | 55-185572[U] |

[51] Int. Cl.[3] ..... B26F 1/04

[52] U.S. Cl. ..... 83/549; 83/216; 83/558; 83/571

[58] Field of Search ..... 83/215, 216, 217, 558, 83/562, 571, 549–551; 234/114–116

[56] References Cited

U.S. PATENT DOCUMENTS

| | | | |
|---|---|---|---|
| 1,062,995 | 5/1913 | Smith | 83/215 X |
| 2,985,052 | 5/1961 | Mentzer et al. | 83/571 X |
| 3,085,458 | 4/1963 | Platt et al. | 83/550 X |
| 3,431,806 | 3/1969 | Peterson . | |
| 3,448,645 | 6/1969 | Graf et al. | 83/560 X |
| 3,449,991 | 6/1969 | Daniels | 83/215 X |
| 3,512,441 | 5/1970 | Benedict | 83/571 |
| 3,539,097 | 11/1970 | Baker | 234/115 |
| 3,762,260 | 10/1973 | Taniguchi | 83/215 X |
| 4,241,632 | 12/1980 | Seo | 83/558 X |

FOREIGN PATENT DOCUMENTS 2228554 12/1974 France .

*Primary Examiner*—James M. Meister

*Attorney, Agent, or Firm*—Wigman & Cohen

[57] ABSTRACT

The present invention relates to a blanking apparatus comprising a press, a ram vertically movably provided on the press, a blanking unit disposed just beneath the ram, blanking tools arranged in the blanking unit; and a striker member for working on the blanking tools. The apparatus is used in particular for blanking a sheet material from a coiled strip into a number of pieces in the form of discs, triangles, and other shapes.

3 Claims, 10 Drawing Figures

BLANKING APPARATUS

BACKGROUND OF THE INVENTION

1. Field of the Invention

The present invention relates generally to an apparatus for cutting or blanking sheet materials such as sheet metals into a number of pieces of various shapes in presses or the like, and more particularly the present invention pertains to an apparatus for blanking from a coiled strip a sheet material into a number of pieces in the form of discs, triangles and other shapes.

2. Description of the Prior Art

In many industries, a coiled strip of a sheet material such as a sheet metal is continuously cut or blanked by a press or the like having upper and lower blanking tools into a number of pieces which are in the form of discs, triangles and other shapes and are usually referred to as blanks. In such a blanking operation, it is of course desired to economically cut the strip into blanks so that the maximum amount of the strip can be utilized to minimize the waste of the strip.

For the purpose of economical blanking, conventionally a wider strip is cut so that a plurality of cuts or blankings are laterally made on the strip in a row normal to the longitudinal edges thereof. Also, when circular disc-like blanks, for example, are to be made from the strip, such a row of the plural cuts are made zigzig or staggered in such a manner that centers of circular cuts of a row will be located in alignment with the midpoints between the circular cuts of the preceding row.

Heretofore, various attempts have been to blank a wider strip so that a plurality of cuts are laterally made on the strip in a row normal to the longitudinal edges thereof. For instance, a plurality of upper and lower blanking tools are grouped into upper and lower sets, respectively, so that a plurality of blanks may be concurrently cut laterally from the strip at each stroke of the upper tools. However, this system will not only required the additional cost for the upper and lower tools but also the larger blanking force that is the larger capacity of the press or the like. Furthermore, this system will make it very often impossible to go on blanking since either of the upper and lower blanking tools is liable to be often broken and also it is time-consuming in changing the upper and lower tools.

SUMMARY OF THE INVENTION

It is a primary object of the present invention to provide a blanking apparatus for economically cutting a strip of a sheet material such as a sheet metal into a number of blanks of various shapes such as discs and triangles so that the maximum amount of the strip can be utilized to minimize the waste of the strip.

It is another object of the present invention to provide a blanking apparatus by which a plurality of blanks can be cut from the strip by a smaller blanking force in a press or the like with a smaller capacity so that a plurality of cuts can be laterally made on the strip in a row normal to the longitudinal edges thereof.

It is a further object of the present invention to provide a blanking apparatus in which the blanking tools can be easily changed when the shape and size of blanks to be blanked from the strip are to be changed.

In order to accomplish the above methioned objects, according to the present invention, a single pair or plural pairs of upper and lower blanking tools are disposed so that they can be automatically moved in a direction normal to the path along which the strip to be blanked is to be fed, and striker means are horizontally movably disposed so as to work on the upper tools.

Other and further objects and advantages of the present invention will be apparent from the following description and accompanying drawings which, by way of illustration, show preferred embodiments of the present invention and the principles thereof.

DESCRIPTION OF THE PREFERRED EMBODIMENTS

Figure 1:
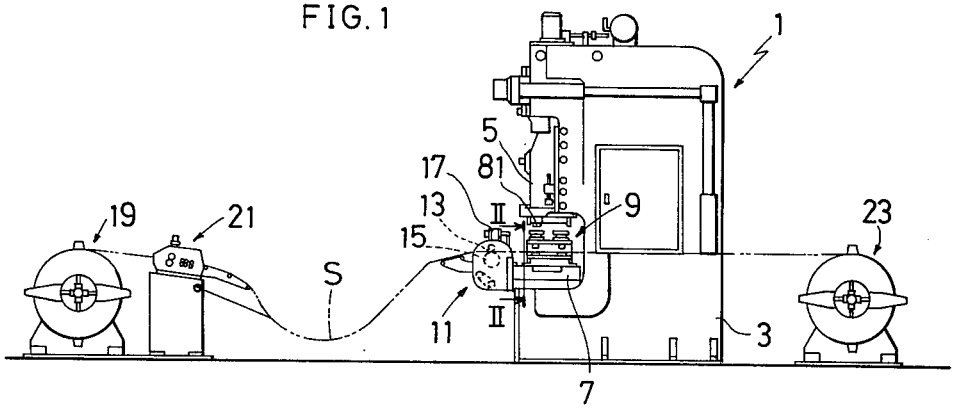
FIG. 1 is a side elevational view of a press embodying the principles of the present invention and shown as incorporated in an automated blanking system.

Referring now to FIG. 1, there is shown a press 1 which is constructed of a C-shaped frame 3 and has a ram 5 vertically movably disposed at the front portion of the frame 3. As is also conventional, a bolster 7 is fixedly mounted just under the ram 5 to hold at its central portion a blanking apparatus 9 which is so designed as to blank or cut a strip S of a sheet material such as a sheet metal into pieces or blanks of shapes such as discs and triangles as will be described in great detail hereinafter. Thus, the ram 5 is vertically moved along the front portion of the frame 3 toward and away from the bolster 7 in a conventional manner to enable the blanking apparatus 9 to blank or cut the strip S into blanks.

In order to feed the strip S to be blanked into the blanking apparatus 9, the bolster 7 is provided at its front portion with a roll feeding apparatus 11 which has a pair of feeding rollers 13 and 15 and is driven preferably by a servomotor 17 under a control such as a numerical control. The strip S is originally held by an uncoiler 19 in a coiled state and is supplied into the blanking apparatus 9 by the roll feeding apparatus 11 from the uncoiler 19 through a leveler 21 in a conventional manner. Also, there is provided behind the press 1 a recoiler 23 for winding the strip S which have been blanked by the blanking apparatus 11 into what is called a skeleton.

In the above described arrangement, the strip S originally coiled on the uncoiler 19 is first uncoiled and leveled by the leveler 21 and then it is fed into the blanking apparatus 9 by the roll feeding apparatus 11. Then, the strip S fed into the blanking apparatus 9 is blanked or cut thereby into a number of blanks of desired shapes such as discs and triangles when the ram 5 of the press 1 is worked on the blanking apparatus 9. Also, the strip S from which blanks have been cut out by the blanking apparatus 9 is lastly recoiled by the recoiler 23 in the state of the skeleton. In this connection, it will be understood that the roll feeding apparatus 11 can be controlled under a control such as a numerical control so as to feed the strip S in synchronism with the blanking apparatus 9 and the ram 5 of the press 1.

Figure 2:
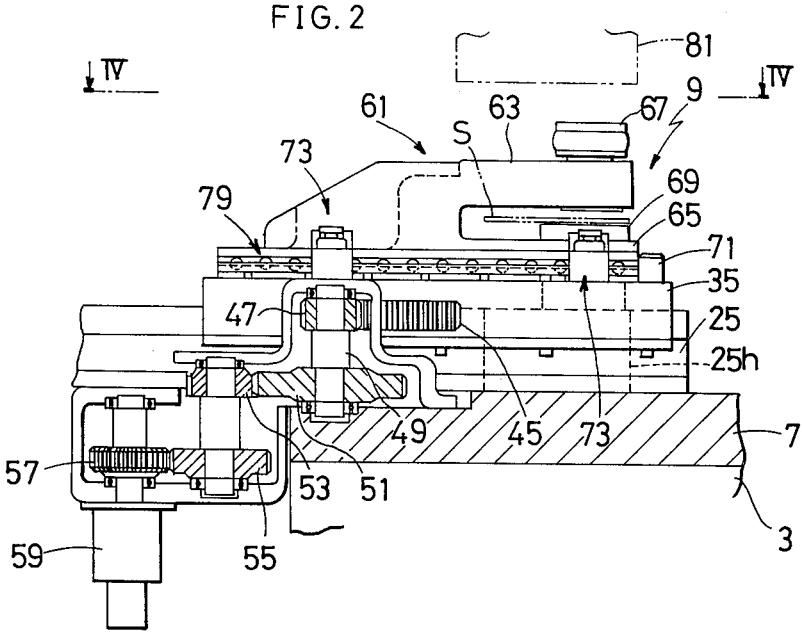
FIG. 2 is a sectional view taken along the line II—II of FIG. 1.
Figure 3:
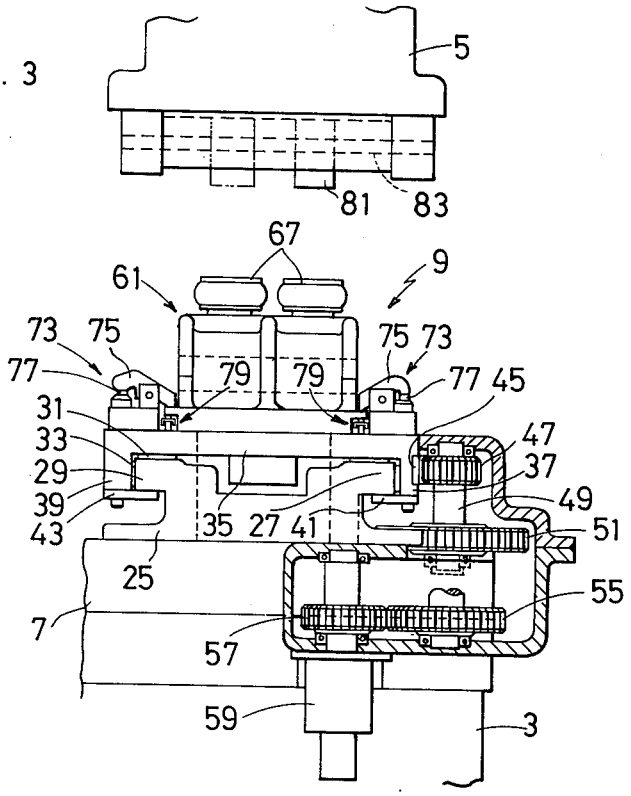
FIG. 3 is a left-hand partial elevational view of the position shown in FIG. 2, partially broken away in section taken along the line III—III of FIG. 4.
Figure 4:
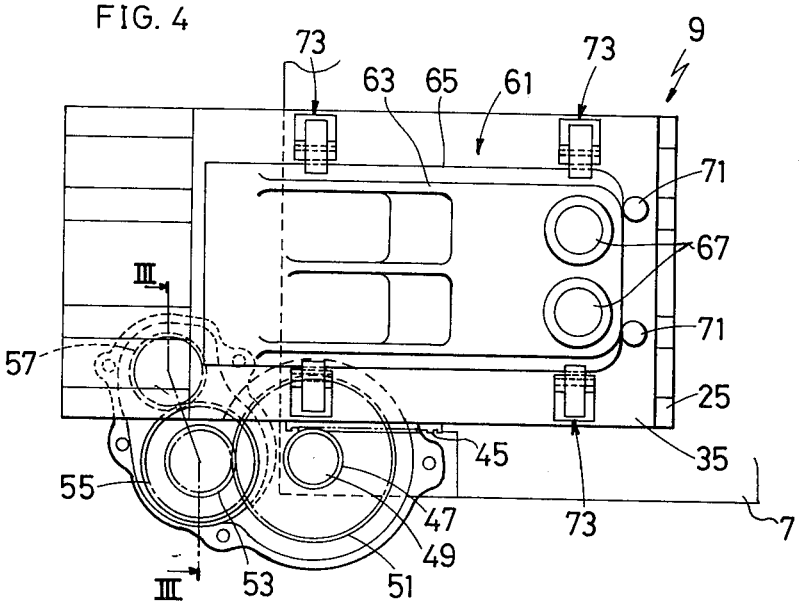
FIG. 4 is a plan view taken on the plane of the line IV—IV of FIG. 2.

Referring to FIGS. 2 through 4, the blanking apparatus 9 comprises a base member 25 which is substantially a rectangular block and is horizontally and fixedly mounted on the bolster 7 at right angles to the path along which the strip S is fed from the roll feeding apparatus 11. The base member 25 is provided at its opposite front and rear ends with a pair of rails 27 and 29, respectively, which are horizontally elongated in parallel with each other and at right angles to the path along which the strip S is fed. Each of the rails 27 and 29 is provided at its top and side with elongated gibs or guide plates 31 and 33, respectively. Also, the base member 25 is formed at its laterally central portion with a vertical hole 25H so that blanks cut from the strip S can be downwardly dropped therethrough.

The blanking apparatus 9 further comprises a carrier member 35 which is slidably mounted on the base member 25 so that it can be moved along the rails 27 and 29. As seen from FIGS. 2 and 3, the carrier member 35 is provided at its opposite front and rear ends with flange-like projections 37 and 39, respectively, which are horizontally elongated in slidable contact with the gibs 33 fixed to the rails 27 and 29 of the base member 25. The carrier member 35 is further provided with elongated plates 41 and 43 which are horizontally fixed to the undersides of the flanges 37 and 39, respectively, and are partially slidably in contact with the undersides of the rails 27 and 29, respectively.

In this arrangement, the carrier member 35 can be horizontally moved on the gibs 31 on the base member 25 by the guide of the gibs 33 and the undersides of the rails 27 and 29. In the preferred embodiment, the carrier member 35 is provided with a rack 45 which is disposed in mesh with a pinion 47 fixed on a shaft 49 so that it can be moved on the base member 25 by the pinion 49. Also, the shaft 49 of the pinion 47 is connected through gears 51, 53, 55, 57 to a servomotor 59 which may be numerically controlled in synchronism with the servomotor 17 for the roll feeding apparatus 11 and the driving means of the ram 5 of the press 1. Thus, it will be now understood that the carrier member 35 is horizontally moved on the base member 25 along the rails 27 and 29 by the servomotor 59 through the pinion 47 and the rack 45.

In order to blank the strip S fed from the roll feeding apparatus 11, the blanking apparatus 9 comprises a blanking unit 61 which is detachably mounted on the carrier member 35. The blanking unit 61 is of a substantially C-shaped frame having an upper arm 63 and a lower arm 65 between which the strip S is fed, and it is provided with a single pair or plural pairs of upper and lower blanking tools 67 and 69 which are shown as two pairs in FIGS. 3 and 4. The upper and lower blanking tools 67 and 69 of the blanking apparatus 9 are mounted on the upper and lower arms 63 and 65, respectively, so that they can cooperate with each other to blank the strip S. Of course, the upper and lower blank tools 67 and 69 in each pair are disposed in vertical alignment with each other so that the upper tool 67 can be lowered into engagement with the lower tool 69 to blank the strip S when depressed by the ram 5. Also, the blanking unit 61 of the above described arrangement is mounted on the carrier member 35 in contact with stopping pins 71 so that the upper and lower blanking tools 67 and 69 are located just under the ram 5 of the press 1 and just above the hole **25*h* of the carrier member 35 wherever the carrier member 35 is moved. Also, the blanking unit 61 is so arranged as to be fixedly clamped on the carrier member 35 by a plurality of clamping means 73, each of which is provided with a clamping lever member 75 pivotally disposed and hydraulically or pneumatically operated by a piston rod 77 in the preferred embodiment. Furthermore, in order to easily position and detach the blanking unit 61, the carrier member 35 is provided with a plurality of ball sliders 79 which are so arranged as to be normally kept retracted from the top surface of the carrier member 35 but are projected therefrom when the blanking unit 61** is to be positioned or detached.

In the above described arrangement, the strip S is fed horizontally between the upper and lower arms 63 and 65 of the blanking unit 61 from the roll feeding apparatus 11 so that it can be cut into blanks by the upper and lower blanking tools 67 and 69 when the ram 5 is lowered to depress the upper blanking tool 67. Also, the blanking unit 61 is held by the carrier member 35 and it is moved thereby to horizontally move the upper and lower tools 67 and 69 just beneath the ram 5 in the direction normal to the path along which the strip S is fed, when the carrier member 35 is moved on the base member 25 by the servomotor 59 by means of the rack 45 and the pinion 47. Thus, in order to utilize the maximum amount of the strip S, blankings can be laterally made on the strip S in a row normal to the longitudinal edges thereof by moving the carrier member 35 on the base member 25 to move the blanking unit 61 in the direction normal to the path of the strip S. Also, it will be understood that blankings can be laterally made on the strip S in a row normal to the longitudinal edges thereof with less blanking force, since a single pair or a few pairs of the upper and lower tools 67 and 69 are used.

As shown in FIGS. 3 and 4, the ram 5 of the press 1 is provided at its lower end with a striker member 81 to strike or depress the upper blanking tool 67 of the blanking unit 61 in the blanking apparatus 9. The striker member 81 is an elongated member and it is horizontally disposed at the lower end of the ram 5 to depress the upper blanking tool 67. Therefore, the striker member 81 is so designed as to be longer than the length by which the upper and lower blanking tools 67 and 69 are moved by the carrier member 35 in the blanking apparatus 9 so that it can depress the upper blanking tool 67 wherever the carrier member 35 is positioned. Also, the striker member 81 of such construction is so arranged as to be horizontally moved forward and rearward along guide rods 83 at the lower end of the ram 5 by a suitable means such as a pneumatic motor 6 so that it can selectively work on either of the pairs of the upper and lower tools 67 and 69. Thus, the striker member 81 can not only work on the upper and lower blanking tools 67 and 69 wherever the carrier member 35 is positioned on the base member 25 but also it can selectively work on either of the pairs of the upper and lower blanking tools 67 and 69.

In the above described arrangement, the striker member 81 can work on the upper and lower blanking tools 67 and 69 which are moved by the carrier member 35 laterally in the direction normal to the feeding path along which the strip S is fed. Thus, it will be understood that the blankings can be made by the strip S by a single pair or a few pairs of the upper and lower tools 67 and 69 with less blanking force with the result that the maximum amount of the strip S is utilized.

Figure 5:
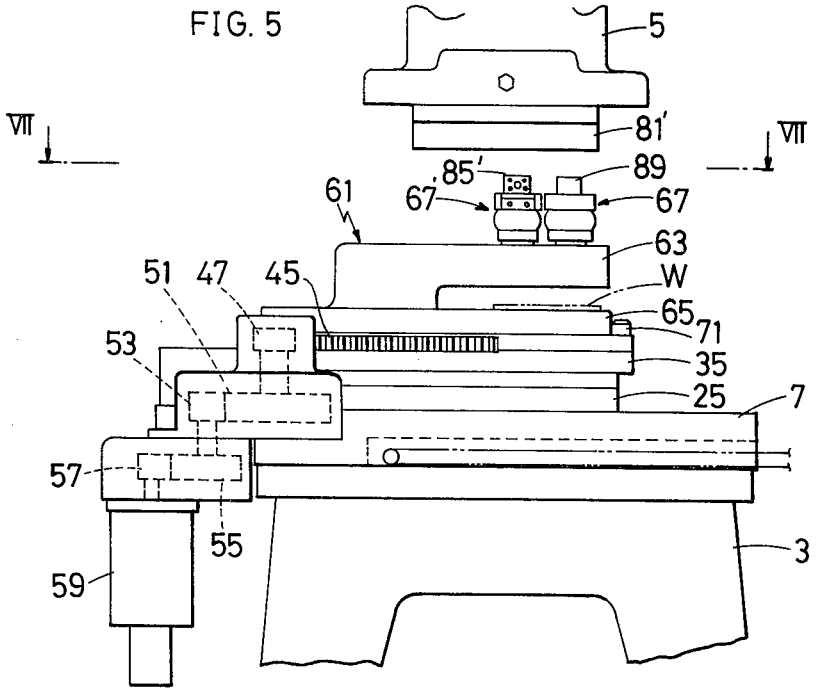
FIG. 5 is a partial front view of a second embodiment of the portion shown in FIG. 1.
Figure 6:
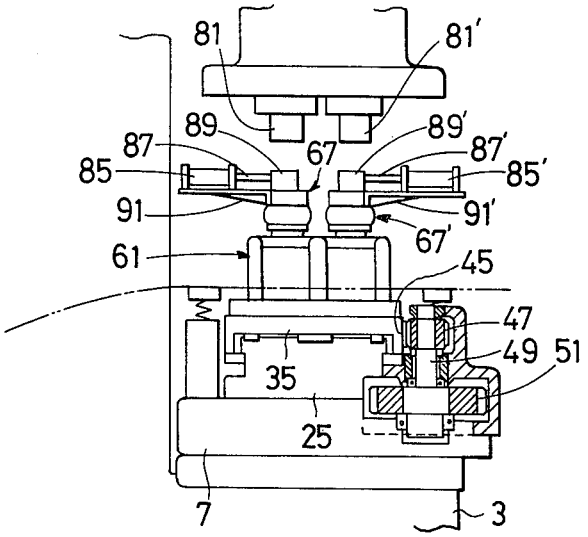
FIG. 6 is a left-hand side elevational view of the portion shown in FIG. 5.
Figure 7:
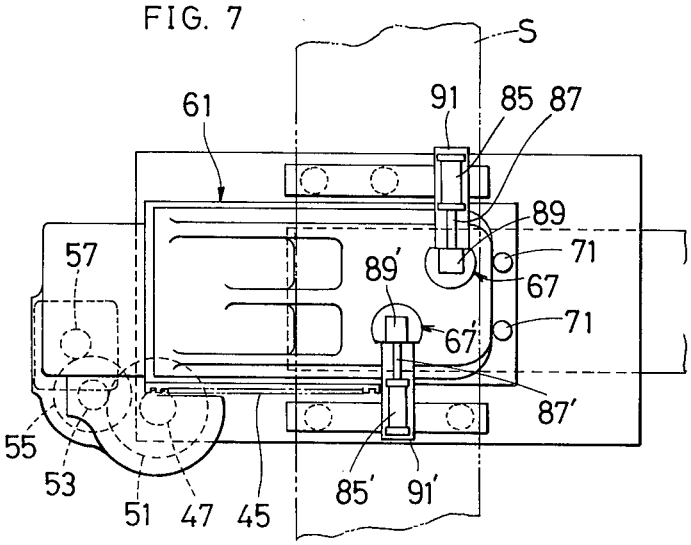
FIG. 7 is a plan view taken on the plane of the line VII—VII of FIG. 5.

Referring next to FIGS. 5 through 7, there is shown a second embodiment of the principles of the present invention. Since the second embodiment is similar to the first embodiment shown in FIGS. 2 through 4, elements common to the first embodiments will be given the same reference numerals as the first embodiment and will not be described in detail.

In the second embodiment, two pairs of the upper and lower blanking tools 67 and 69 are disposed at spaces or distances from each other both in the direction in which the strip S to be blanked is fed and in the direction normal to the path along which the strip S is fed. As best shown in FIG. 7, two upper blanking tools 67 and 67' are mounted on the upper arm 63 (see FIG. 5) of the blanking unit 61 out of alignment with each other, and two lower blanking tools (not shown) mating with the upper blanking tools 67 and 67' are disposed likewise.

As best shown in FIGS. 6 and 7, a pneumatic or hydraulic motor 85 having a piston rod 87 to which a block member 89 is fixed is disposed on the bracket 91 in such a manner that the block member 89 can be brought into and out of contact with the top of the upper blanking tool 67. More specifically, the arrangement is such that the block member 89 is placed on the top of the upper blanking tool 67 when the piston rod 87 is kept extended and it is retacted therefrom when the piston rod 87 is retracted. Also, another pneumatic or hydraulic motor 85' having a piston rod 87' and a block member 89' is likewise disposed so that the block member 89' can be brought into and out of contact with the top of the upper blanking tool 67'. On the other hand, two strikers 81 and 81' are provided at the lower end of the ram 5 of the press 1 in vertical alignment with the upper blanking tools 67 and 67', respectively, as best shown in FIG. 6.

In the second embodiment of the above described arrangement, both of the upper tools 67 and 67' are concurrently depressed by the striker members 81 and 81', respectively, by means of the block member 89 and 89', respectively, when both of the piston rods 87 and 87' of the pneumatic or hydraulic motors 85 and 85' are extended. When either of the piston rods 87 and 87' is retracted to move the block members 89 and 89' out of contact with the top of the upper blanking tools 67 and 67', neither of the striker members 81 and 81' can work on either of the upper tools 67 and 67'. Thus, it will be understood that either of the upper blanking tools 67 and 67' can be selectively used to blank the strip S in the second embodiment by working either of the pneumatic or hydraulic motor 85 and 85'. Also, it will be readily understood by those skilled in the art that the block members 89 and 89' can be likewise disposed at the lower end of the ram 5 of the press 1.

Figure 8:
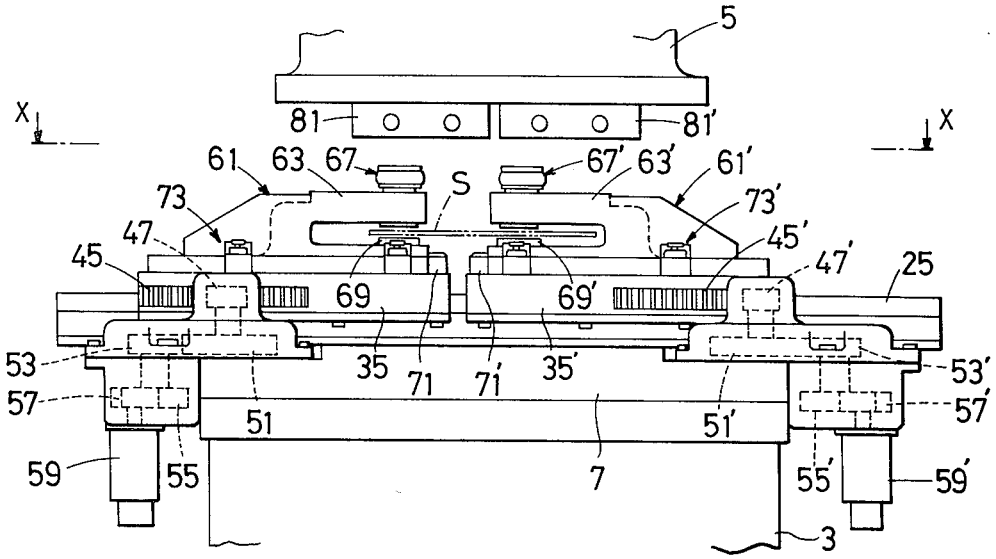
FIG. 8 is a partial front view of a third embodiment of the portion shown in FIG. 1.
Figure 9:
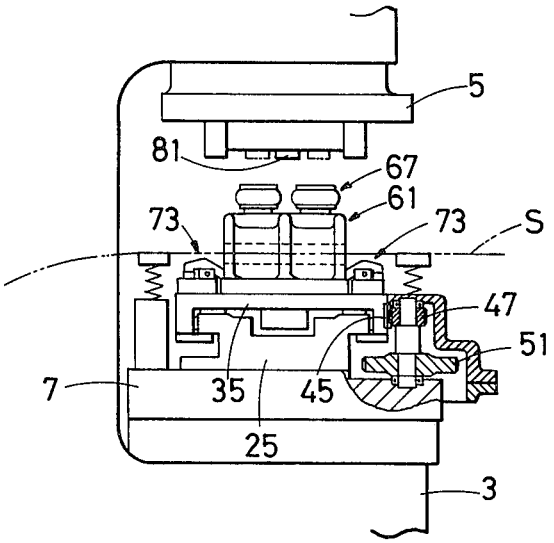
FIG. 9 is a left-hand side elevational view of the portion shown in FIG. 8.
Figure 10:
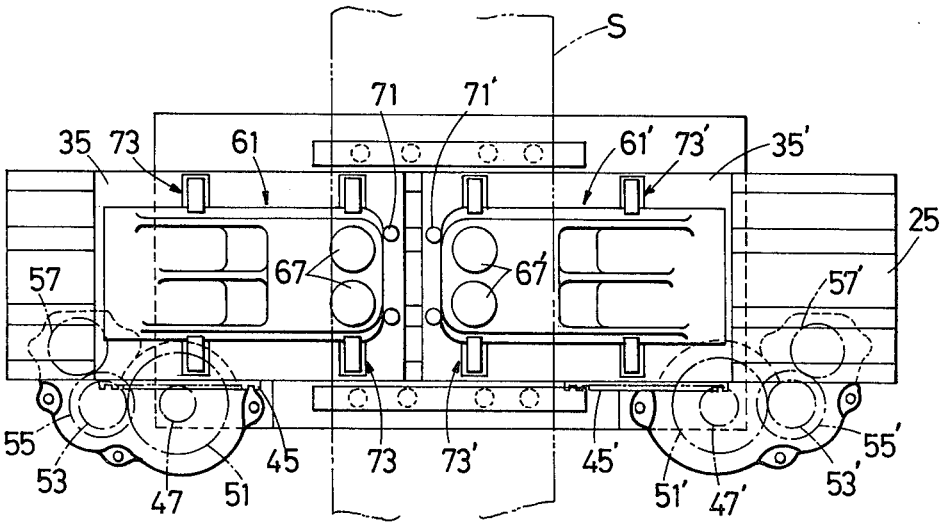
FIG. 10 is a plan view taken on the plane of the line X—X of FIG. 8.

Referring to FIGS. 8 throught 10, there is shown a third embodiment of the principles of the present invention. Since this third embodiment is similar to the first and the second embodiments, elements common to them will be given the same reference numerals and will not be described in detail.

In the third embodiment, two blanking units 61 and 61' carried by two carrier member 35 and 35', which are all the same in construction and function as the first embodiment, are symmetrically or oppositely mounted on both sides of the feeding path along which the strip S is fed. However, the blanking units 61 and 61' and the carrier members 35 and 35' can be disposed either in or cut of alignment with each other on both sides of the feeding path of the strip S. In this third embodiment, it is possible to efficiently blank a wider strip S in such a manner as to utilize the maximum amount of the strip S.

Although a preferred form of the present invention has been illustrated and described, it sould be understood that the device is capable of modification by one skilled in the art without departing from the principles of the invention. Accordingly, the scope of the invention is to be limited only by the claims appended hereto.

We claim:

1. A blanking apparatus, comprising:

a press;

a ram vertically movably provided on the press;

two blanking units being disposed just beneath the ram and further being so disposed so as to be horizontally movable in a direction normal to a feeding path along which a strip to be blanked is fed;

blanking tools being arranged in the blanking units; and a striker member for working on the blanking tools, said striking member being longer than the length by which the blanking unit is movable, means for moving said striking member horizontally in the direction of the feeding path such that said striking member may be selectively moved in alignment with either of said blanking units, and said striking member further being provided at a lower end of the ram.

2. The blanking apparatus defined in claim 1, further comprising:

a carrier member being horizontally movable in the direction normal to the feeding path along which the strip to be blanked is fed;

said blanking units being detachably mounted on the carrier member.

3. The blanking apparatus defined in claim 1, wherein:

said blanking units, being arranged on both sides of the feeding path along which the strip to be blanked is fed, are so provided as to be movable at right angles to the feeding path; and said blanking tools are provided in the blanking units at a space from each other along the feeding path.

* * * * *